US005364540A

United States Patent [19]

Sciuto

[11] Patent Number: 5,364,540

[45] Date of Patent: Nov. 15, 1994

[54] FILTER DRIER AND METHOD OF FILTERING A FLUID STREAM

[75] Inventor: George J. Sciuto, St. Louis, Mo.

[73] Assignee: Emerson Electric Co., St. Louis, Mo.

[21] Appl. No.: 16,453

[22] Filed: Feb. 11, 1993

[51] Int. Cl.[5] ..... B01D 27/03; F25B 43/00

[52] U.S. Cl. ..... 210/806; 55/486; 62/474; 210/266; 210/289; 210/291; 210/350; 210/352; 210/446; 210/689; 210/DIG. 6

[58] Field of Search ..... 210/264, 266, 282, 283, 210/285, 287, 289, 290, 291, 352, 356, 483, 484, 485, 435, 446, 451, 456, 689, 806, DIG. 6, 350, DIG. 7; 62/85, 474; 55/315, 486, 487, 509

[56] References Cited

U.S. PATENT DOCUMENTS 2,325,657 8/1943 Burkness ..... 210/DIG. 6
3,841,490 10/1974 Hoffman et al. ..... 210/DIG. 6
4,637,881 1/1987 Sciuto ..... 210/689
4,811,571 3/1989 Mayer ..... 62/474

*Primary Examiner*—Sun Uk Kim
*Attorney, Agent, or Firm*—Polster, Lieder, Woodruff & Lucchesi

[57] ABSTRACT

An apparatus and method for filtering a fluid stream wherein the fluid stream is passed through a first filtering zone to remove particulate materials therefrom above a first preselected micron level, then through a desiccant media bed zone including a multiplicity of desiccant beads to dry the fluid stream and then through a second filtering zone to remove particulate materials therefrom above a second preselected micron level below said first micron level so as to remove smaller particulate materials including particulates from said first filtering zone.

10 Claims, 2 Drawing Sheets

FILTER DRIER AND METHOD OF FILTERING A FLUID STREAM

BACKGROUND OF THE INVENTION

The present invention relates to a filter drier and method of filtering a fluid stream and more particularly to an improved apparatus and method for filtering and drying liquid refrigerant in a refrigerant system. The present invention provides a unique and useful improvement to the method and apparatus disclosed in U.S. Pat. No. 4,637,881, issued to George J. Sciuto on Jan. 20, 1987.

As is discussed in above U.S. Pat. No. 4,637,881, filter driers utilizing a bed of desiccant beads .and filter pads for drying and removing particulate materials from fluid systems, such as refrigerant systems, are generally well known in the art and in refrigerant systems they have served to remove moistures and acids from the refrigerant, filtering particles of metal, dirt or grit from refrigerants to prevent operational damage to the compressors and other components of the system. It also has been generally well known in the art to provide filter media pads upstream and downstream beds of desiccant beads, attention being directed to U.S. Pat. Nos. 3,170,872, issued to S. Balough et al on Feb. 23, 1965; 3,815,752, issued to J. E. Hoffman et al on Jun. 11, 1974; 4,177,145, issued to E. W. Schumacher on Dec. 4, 1979; 4,209,401, issued to P. V. Henton on Jun. 24, 1980; 4,364,756, issued to J. P. Clarke et al on Dec. 21, 1982; and, to the aforementioned U.S. Pat. No. 4,637,881. This latter patent-recognizing past problems in the art relating to flow and filtration characteristics—provides a unique apparatus and method which relies on both a fluid diffusion concept and a concept of desiccant compaction which is complimentary to fluid flow compaction to minimize desiccant roiling erosion and escapement, to enhance desiccant absorption and to generally enhance particulate filtering from the fluid stream treated. The present invention, recognizing the desirability of maintaining these unique concepts and at the same time recognizing certain limitations of the past art in filtering fine particulates from a fluid stream, such as might be present in a refrigerant stream prior to treatment or which might result as carryover from the filter treatment process itself, provides a still further unique apparatus and method which effectively prevents such fine particulate carryover from occurring in the treated fluid stream without substantially increasing pressure drop by utilizing generally known principals in a unique and novel manner.

Various other features of the present invention will become obvious to one skilled in the art upon reading the disclosure set forth herein.

BRIEF SUMMARY OF THE INVENTION

More particularly, the present invention provides a fluid filter drier for filtering and drying fluids in a fluid flow path comprising: a housing having an upstream fluid inlet and a downstream fluid outlet to define a fluid flow path there between; a desiccant media bed including a multiplicity of desiccant beads disposed within the housing between the upstream fluid inlet and downstream fluid outlet transverse the fluid flow path; a first filter means disposed within the housing upstream the desiccant media bed and downstream the upstream fluid inlet of the housing transverse the fluid flow path for filtering undesirable particulate materials above a first preselected micron level; a second filter means disposed within the housing downstream the desiccant media bed and upstream the downstream fluid outlet of the housing transverse the fluid flow path for filtering undesirable particulate materials below the first preselected micron level and above a second preselected micron level below the first preselected micron level; and, compaction means to maintain the desiccant media bed in a compacted state with the first filter means being substantially free of compression by the compaction means.

Further, the present invention provides a novel method of filtering and drying fluids of a fluid stream comprising: passing the fluid stream to be filtered and dried through a first enclosed filtering zone including filter pad means extending transversely to the fluid stream to remove particulate material above a first preselected micron size from the fluid stream; passing the filtered fluid stream through a second enclosed zone including desiccant materials to dry the fluid stream by absorption of moisture, acid and other undesirable contaminants from the fluid stream; and, passing the filtered and dried fluid stream through a third enclosed zone including filter pad means extending transversely to the filtered and dried fluid stream to remove particulate material below the first preselected micron size and above a second preselected micron size to include the filtering of loose particulates of the filter pad means in the first zone and desiccant particles of the second zone. In addition, the present invention not only incorporates the features of the present invention with those of U.S. Pat. No. 4,637,881 but also provides an apparatus and method of filtering particulates from the fluid stream even below twenty (20) microns in size by utilizing a fine filter pad member downstream those aforedescribed filtering pads.

It is to be understood that various changes can be made by one skilled in the art in one or more parts and steps of the invention described herein without departing from the scope or spirit of the present invention.

DETAILED DESCRIPTION OF THE DRAWINGS

Figure 1:
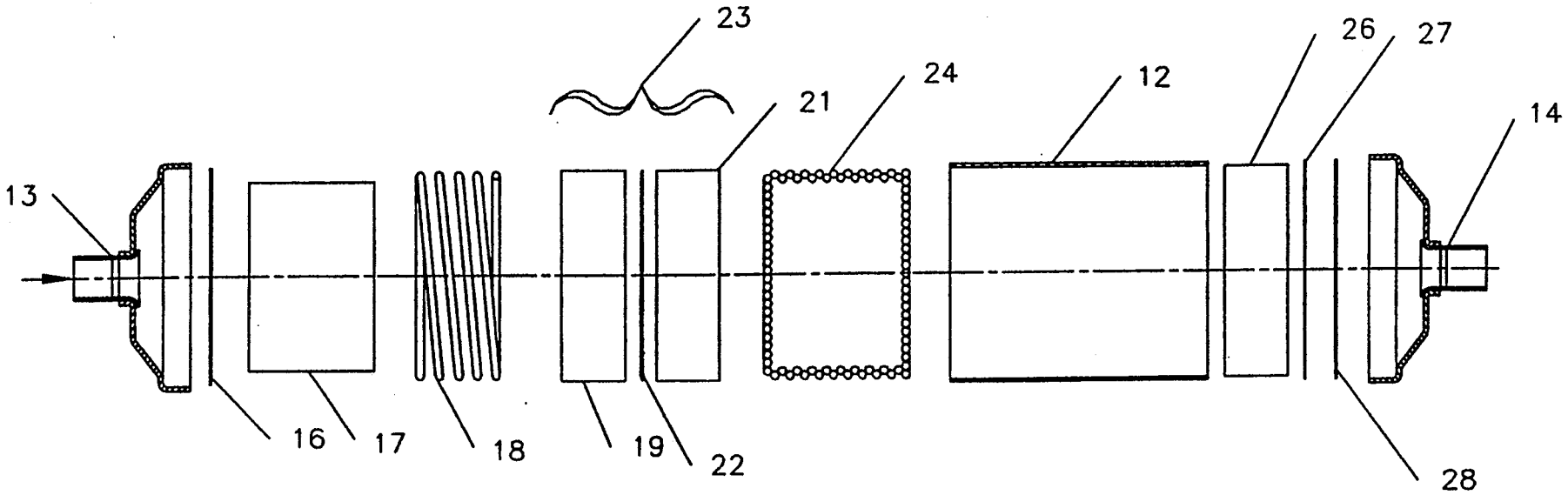
FIG. 1 is a longitudinal cross-sectional view in exploded form of the filter drier apparatus of the present invention.
Figure 2:
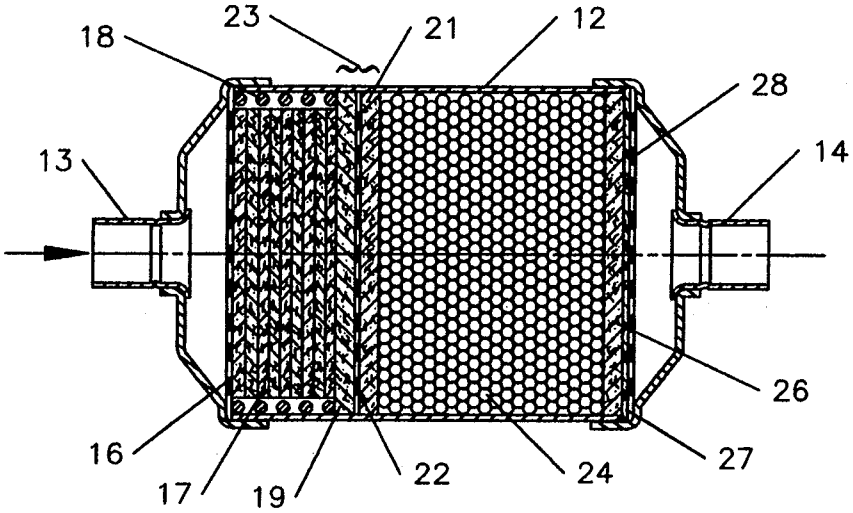
FIG. 2 is a longitudinal cross-sectional view in assembled from of the filter drier of FIG. 1; and, FIG. 3 is a schematic view of a typical refrigeration system which can incorporate the novel filter drier of FIGS. 1 and 2.
Figure 3:
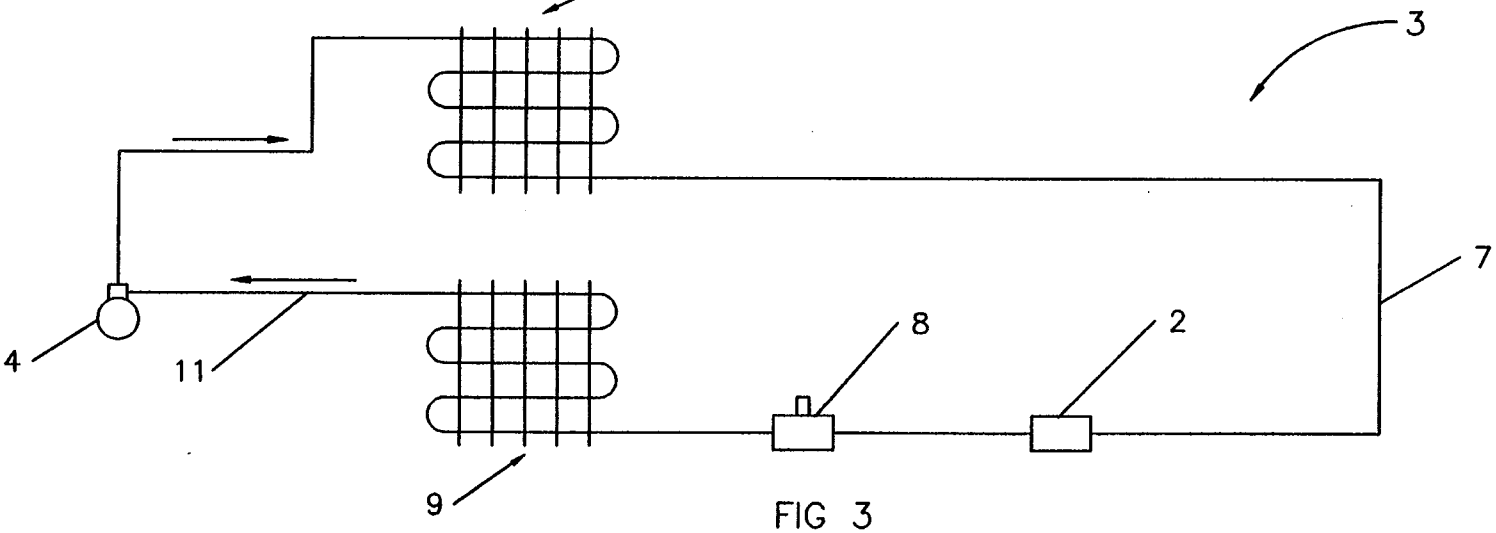

Referring to FIGS. 1 and 2 of the drawings, a structural fluid filter drier arrangement 2, which in many ways can be like that disclosed in above mentioned U.S. Pat. No. 4,637,881, is disclosed, this structural arrangement further including the unique downstream filtering construction of the present invention. Although it is within the scope of the present invention to utilize the novel filter drier 2 in other environments, it is shown in FIG. 3 in a refrigerant system 3 like that disclosed in the aforementioned U.S. Pat. No. 4,637,881. Refrigerant system 3 includes a compressor 4 which supplies high pressure gaseous refrigerant to condenser coil 6 with liquid refrigerant exiting condenser coil 6 to be carried as liquid refrigerant by line 7 to the novel filter drier unit 2, the expansion valve 8 and the evaporator coil 9 before returning as a superheated refrigerant vapor to compressor 4 through suction line 11. The over-all arrangement of the several parts of refrigerant system 3 generally is well-known in the art, the novelty of the present invention resting in the unique compressor protective features of filter drier 2.

Drier 2 of the present invention includes a longitudinally extending, cylindrically shaped, metallic drier housing 12. Generally, housing 12 can have an internal diameter of approximately two and one half ($2\frac{1}{2}$) to three and one half ($3\frac{1}{2}$) inches and a length of approximately three and three quarters ($3\frac{3}{4}$) to twelve (12) inches, the specific size of drier 2 depending upon the volume and nature of the fluid system with which it is employed. Advantageously, drier housing 12 can be constructed of a suitable metal such as stainless steel or painted cold rolled steel to include an upstream fluid inlet 13 and a downstream fluid outlet 14 in the form of suitable, brazed or welded metal fittings, such as copper or steel fastened to shell heads, the filter drier 2 being positioned in refrigerant system 3 between condenser 6 and evaporator coil 9 as shown in FIG. 3 to receive a jet stream of liquid refrigerant through upstream inlet 13. A first perforated, rust inhibited, metal screen 16 serves as a diffuser plate having a plurality of nine hundred (900) holes minimum to substantially uniformly diffuse the refrigerant jet across the area of the plate, the plate or screen being secured to housing 12 adjacent the upstream fluid inlet 13 to extend in transverse relation to the longitudinal axis of housing 12 and to the jet stream to diffuse the same. Screen 16 can be 0.024 inches thick to include 0.075 inch diameter perforated holes with 0.100 inch staggered centers, providing an approximately fifty (50) percent open area.

A first fiberglass pad 17 is arranged to extend parallel and adjacent metal screen 16. In accordance with one feature of the present invention, fiberglass pad 17 is carefully preselected to have a filtering capability to filter out particulate materials from the diffused jet stream above a fifty (50) micron level. Advantageously, pad 17 can have a one (1) pound per cubic foot density with a thickness of approximately two (2) inches to be reduced advantageously by proper sizing of the length of drier housing 12 to approximately sixty-six (66) percent of the original thickness.

A helically coiled, metallic compaction or compression spring 18 is provided within housing 12 in surrounding relation to fiberglass pad 17. This spring 18 serves to resiliently bias second and third glass pads, 19 and 21 respectively. Both of these pads 19 and 21 can be approximately one (1) inch in thickness, advantageously also having a density of one pound per cubic foot and can advantageously be compacted by spring 18 to approximately eighty (80) percent of their original thicknesses. Pads 19 and 21 include a second perforated metal screen 22 therebetween to form pad and screen assembly 23 extending in transverse relation to the longitudinal axis of drier housing 12 to be axially movable, thus bearing against and being in compressing relation to desiccant bed 24. Desiccant bed 24 can be made of compacted desiccant beads of any suitable desiccant, molecular sieve, desiccant material such as alumina, activated carbon, silica gel, zeolite or other materials typically utilized in filter driers for adsorbing and/or absorbing moisture, acid and other contaminants from a fluid flow. The bed 24 can be of hard, ceramic-like materials compacted to remove as much interstitial space between beads as possible to minimize relative bead movement during operation. Bed 24, like pad and screen assembly 23 extends transversely across housing 12 to be compacted by compaction spring 18 through the axially movable, pressure distributing, pad assembly 23 abutting bed 24.

Further in accordance with the present invention, positioned downstream and adjacently parallel desiccant bed 24 to also extend transverse the fluid stream flow path is a fourth fiber glass pad 26. This pad 26, with a thickness, density and compressibility similar to pads 19 and 21, has a capability of filtering undesirable particulate material from the diffused fluid stream above a twenty (20) micron level so as to capture stray particulate materials and fibers for the fiber glass pads 17, 19 and 21 and the desiccant bed 24. In addition, and successively downstream fiber glass pad 26, parallel thereto, is a felt, woven or spun synthetic pad 27 and perforated screen similar to screens 16 and 22. It is to be noted that fiber glass pads 17 and 26 can be of preselected thickness relative the overall length of drier housing 12 so as to be compressed to a preselected density for successfully filtering particulate materials above the fifty (50) and twenty (20) microns respectively.

Thus, in accordance with the present invention a unique apparatus and method for filtering and drying fluids, such as liquid refrigerants is provided in an inexpensive, straight-forward and economical manner. Broadly, in carrying out the inventive method, a diffused fluid stream is passed through a first enclosed filtering zone having a filter pad therein to remove particulate above a first preselected micron size, advantageously particulates above fifty (50) microns. The fluid stream then is passed through a second enclosed zone of compacted desiccant beads to dry the stream by moisture adsorption and/or absorption of acids and other undesirable contaminants and then is passed through a third enclosed zone having a filter pad assembly therein, to remove particulate materials above a second preselected micron level and below the first preselected micron level, advantageously above twenty (20) microns, to thus remove particulate carry-overs from the first and second zone.

The invention claimed is:

1. A fluid filter drier for filtering and drying fluids in a fluid flow path comprising:

a longitudinal housing having an upstream fluid inlet and a downstream fluid outlet to define a fluid flow path therebetween;

a desiccant media bed including a multiplicity of desiccant beads disposed within said housing between said upstream fluid inlet and downstream fluid outlet transverse said fluid flow path;

a first filter means disposed within said housing upstream said desiccant media bed and downstream said upstream fluid inlet of said housing transverse said fluid flow path for filtering undesirable particulate materials above a first preselected micron level of fifty (50) microns; said first filter means having a preselected density of one pound per cubic foot and sized relative the overall length of said housing to be compressed a preselected amount of approximately sixty-six (66) percent of the original thickness through its disposition within said longitudinal housing;

a second filter means of a like predetermined density as said first filter means and disposed within said housing downstream said desiccant media bed and upstream said downstream fluid outlet of said housing transverse said fluid flow path for filtering undesirable particulate materials below said first preselected micron level and above a second preselected micron level of twenty (20) microns, which is below said first preselected micron level; and, compaction means to maintain said desiccant media bed in a compacted state with said first filter means being substantially free of compression by said compaction means and said second filter means being compacted a preselected amount of approximately eighty (80) percent of the original thickness by said compaction means.

2. The fluid filter drier of claim 1, said compaction means comprising a compression spring disposed between said upstream fluid inlet and said desiccant media bed in surrounding relation to said first filter media so that said first filter media is free of compaction thereby.

3. The fluid filter drier of claim 1, said first filter means including at least one fiber glass pad disposed between a pair of substantially flat upstream and downstream filter screens.

4. The fluid filter drier of claim 3, wherein said first filter means includes a second fiberglass pad disposed between said pair of screens and a third fiber glass pad disposed downstream said downstream filter screen.

5. The fluid filter drier of claim 1, said second filter means comprising an assembly of at least one fiber glass pad followed successively downstream by a felt pad and a substantially flat screen upstream said downstream outlet.

6. The fluid filter drier of claim 1, said second filter means being substantially free of compaction by said compaction means.

7. A fluid filter drier for filtering a liquid refrigerant in a refrigerant system including a compressor, an evaporator and a condenser comprising:

a longitudinally extending cylindrical metallic drier housing having an upstream fluid inlet and a downstream fluid outlet positioned in said refrigerant system between said condenser and said evaporator to receive a jet stream of liquid refrigerant through said fluid inlet;

a first perforated metal screen positioned in said housing adjacent said fluid inlet to extend in transverse relation to the longitudinal axis of said housing and to said jet stream of refrigerant to diffuse said jet stream;

a first fiber glass pad extending parallel and adjacent said first screen and having a capability of filtering undesirable particulate materials from said diffused jet stream above a fifty (50) micron level;

a helically coiled metallic compaction spring disposed within said drier housing in surrounding relation with said first fiber glass pad;

a second and third fiber glass pad assembly disposed within said dryer housing downstream said compaction spring to be abutted thereby, said pad assembly including a second perforated metal screen therebetween, said pad and screen assembly also extending in transverse relation to the longitudinal axis of said housing and to said diffused jet stream of refrigerant;

a desiccant media bed including a multiplicity of activated beads disposed within said housing immediately downstream said pad assembly and extending transversely thereacross to be compacted by said helical spring and abutting pad assembly;

a fourth fiber glass pad, extending downstream of and adjacently parallel said desiccant media bed having a capability of filtering undesirable particulate material from said diffused stream above a twenty (20) micron level including stray particulate materials and fibers from said first, second and third pads and desiccant media bed;

a felt pad and third perforated screen assembly disposed within said dryer housing downstream said fourth fiber glass pad also to extend transversely across said longitudinal axis of said housing adjacent said housing outlet, said first and fourth fiberglass filter pads being of a preselected thickness relative the overall length of said drier housing to be compressed to a preselected density for filtering particulate materials above fifty, (50) and twenty (20) microns respectively;

said first perforated metal screen having approximately fifty (50) percent of the overall area opened; said first fiber glass pad with a density of one pound per cubic foot being sized relative the overall length of said housing to be compressed approximately sixty-six (66) percent of the original thickness and said second and third pads with a density of one pound per cubic foot being compacted by said compaction springs to approximately eighty (80) percent of the original thickness.

8. A method of filtering and drying fluids of a fluid stream comprising:

passing said fluid stream to be filtered and dried through a first enclosed filtering zone including filter pad means having a preselected density of one pound per cubic feet and extending transversely to said fluid stream in a preselected compressed state of approximately sixty-six (66) percent of the original thickness to remove particulate material above a first preselected micron size of fifty (50) microns from said fluid stream;

passing said filtered fluid stream through a second enclosed zone including desiccant materials to dry said fluid stream by absorption of moisture, acid and other undesirable contaminants from said fluid stream; and, passing said filtered and dried fluid stream through a third enclosed zone including filter pad means of similar density as said first filter pad means and extending transversely to said filtered and dried fluid stream in a preselected compressed state of approximately eighty (80) percent of the original thickness to remove particulate material below said first preselected micron size and above a second preselected micron size of twenty (20) microns to include the filtering of loose particulates of said filter pad means in said first zone and desiccant particles of the second zone.

9. The method of filtering and drying fluids of a fluid stream of claim 8 wherein said desiccant materials are comprised of a multiplicity of desiccant beads held in a compressed state.

10. A method of filtering and drying a liquid refrigerant in a refrigerant system comprising:

passing a refrigerant jet stream in said refrigerant system through an enclosed diffuser zone extending transverse said stream between an evaporator zone and a condenser zone in said refrigerant system;

passing said diffused refrigerant stream immediately thereafter through a first enclosed unitary filtering zone including filter pad means having a density of one pound per cubic foot and extending transversely to said fluid stream in a compressed state of approximately sixty-six (66) percent of the original thickness to remove particulate material therefrom above fifty (50) micron size from said diffused refrigerant stream;

passing said refrigerant stream immediately thereafter through a second enclosed filtering zone including a compressed filter pad assembly extending in transverse relation to said refrigerant stream;

passing said filtered refrigerant stream through a third enclosed zone including compressed desiccant materials to dry said refrigerant stream by absorption of moisture, acid and other undesirable contaminants from said refrigerant stream; and, passing said filtered and dried refrigerant stream through a fourth enclosed unitary filtering zone including filter pad means also having a density of one pound per cubic foot and extending transversely to said fluid stream compacted to about eighty (80) precent of the original thickness to remove particulate materials above twenty (20) micron size to include filtering of loose particulates from said previous filtering zones.

* * * * *